United States Patent [19]

Yamada

[11] Patent Number: 4,489,684

[45] Date of Patent: Dec. 25, 1984

[54] FUEL INJECTION PUMP ASSEMBLY

[75] Inventor: Keiichi Yamada, Ohmiya, Japan

[73] Assignee: Diesel Kiki Co., Ltd., Tokyo, Japan

[21] Appl. No.: 372,242

[22] Filed: Apr. 26, 1982

[30] Foreign Application Priority Data

May 6, 1981 [JP] Japan ..... 56-066858

[51] Int. Cl.[3] ..... F02M 63/02

[52] U.S. Cl. ..... 123/198 F; 123/449; 123/458; 417/302; 417/442

[58] Field of Search ..... 123/198 F, 503, 449, 123/450, 458; 417/302, 282, 289, 294, 494, 499, 500, 442

[56] References Cited

U.S. PATENT DOCUMENTS 3,404,668 10/1968 Eheim ..... 123/449

3,896,779 7/1975 Omori ..... 123/198 F

*Primary Examiner*—Charles J. Myhre

*Assistant Examiner*—Carl Stuart Miller

*Attorney, Agent, or Firm*—Wenderoth, Lind & Ponack

[57] ABSTRACT

A fuel injection pump assembly comprises a plunger rotatably and telescopically mounted in a pump cylinder and having a plurality of fuel supply slots which are as many as the engine cylinders and movable in response to rotation of the plunger for selective communication with a pair of fuel inlet ports in the pump cylinder. The fuel supply slots are half as many as the engine cylinders and angularly equally spaced at a first angle. The fuel inlet ports are angularly spaced from each other at a second angle which is equal to the product of the first angle and [$(\frac{1}{2})+n$ ($n=0$ or a positive integer)]. The plunger is rotatable about its own axis in response to rotation of the engine and reciprocable in strokes which are as many as the engine cylinders per rotation of the engine for selectively supplying fuel from the fuel inlet ports through the fuel supply slots, through a pressurization chamber in the pump cylinder, and through a passageway in the plunger to fuel distribution ports in the pump cylinder which are connected to the engine cylinders via delivery valves. The fuel inlet ports are selectively opened and closed by solenoid-operated valves to disable selected engine cylinders by cutting off fuel supply thereto.

4 Claims, 4 Drawing Figures

FUEL INJECTION PUMP ASSEMBLY

BACKGROUND OF THE INVENTION

1. Field of the Invention

The present invention relates to a fuel injection pump assembly for distributing and supplying fuel to cylinders of an internal combustion engine such as a diesel engine.

2. Description of the Prior Art

Diesel engines for use on automobiles require that fuel combustion be uniform and fuel ignition be regular in a desired range of speeds and loads, and fuel combustion be reliable and regular at idling speeds which are about one-eighth or one-ninth of the maximum rated speed.

It is however customary to design automotive diesel engines such that air flow in combustion chambers or cylinders, the rate of fuel injection, and atomization characteristics will be balanced for smokeless fuel combustion when the engine operates at a high speed or under a maximum speed. When the engine is idling, fuel atomization is poor and air in the combustion chambers fails to get mixed well with injected fuel, with the results that fuel ignition and combustion are unstable and the fuel undergoes incomplete combustion due to a low temperature in the combustion chambers, producing black smoke and smelly exhaust gas.

A fuel injection system having a plurality of fuel injection pumps for supplying fuel respectively to engine cylinders either includes two fuel reservoirs which are selectively closed to cut off fuel supply to one group of fuel injection pumps, or has the leads of pump plungers varied respectively for the corresponding engine cylinders. When the engine operates at a low speed or under a low load, some of the engine cylinders are disabled or rendered inoperative by cutting off the fuel supply, so that an increased amount of fuel can be injected into the remaining operating engine cylinders. Fuel combustion in the engine cylinders can thus be improved to thereby reduce generation of black smoke and smelly exhaust gas for improving fuel economy and engine warm-up operation.

However, there has been known no fuel injection pump assembly for distributing a controlled amount of fuel among engine cylinders while at the same time improving fuel combustion therein for reduction of black smoke and smelly exhaust gas.

SUMMARY OF THE INVENTION

It is an object of the present invention to provide a fuel injection pump assembly for distributing a controlled amount of fuel among engine cylinders by cutting off the supply of fuel to selected cylinders of an engine while the latter is idling or operating under light loads, to inject an increased amount of fuel into the remaining cylinders for improving fuel combustion therein to prevent generation of black smoke and smelly exhaust gas which would otherwise result from incomplete fuel combustion.

According to the present invention, a plunger of a fuel injection pump assembly has a plurality of fuel supply slots which are as many as engine cylinders and movable in response to rotation of the plunger for selective communication with a pair of fuel inlet ports in a pump cylinder. The fuel supply slots are half as many as the engine cylinders and angularly equally spaced at a first angle. The fuel inlet ports are angularly spaced from each other at a second angle which is equal to the product of the first angle and $[(\frac{1}{2})+n$ ($n=0$ or a positive integer)]. The plunger is rotatable about its own axis in the pump cylinder in response to rotation of the engine and reciprocable in strokes which are as many as the engine cylinders per rotation of the engine for selectively supplying fuel from the fuel inlet ports through the fuel supply slots, a pressurization chamber in the pump cylinder, and a passageway in the plunger to distribution ports in the pump cylinder which are connected to the engine cylinders via delivery valves. The fuel inlet ports are selectively opened and closed by solenoid-operated valves to disable selected engine cylinders by cutting off fuel supply thereto.

The above and other objects, features and advantages of the present invention will become more apparent from the following description when taken in conjunction with the accompanying drawings in which certain preferred embodiments of the present invention are shown by way of illustrative example.

BRIEF DESCRIPTION OF THE DRAWINGS

FIG. 1(*b*) is an enlarged cross-sectional view taken along line A—A of FIG. 1(*a*);

DESCRIPTION OF THE PREFERRED EMBODIMENTS

Figure 1A:
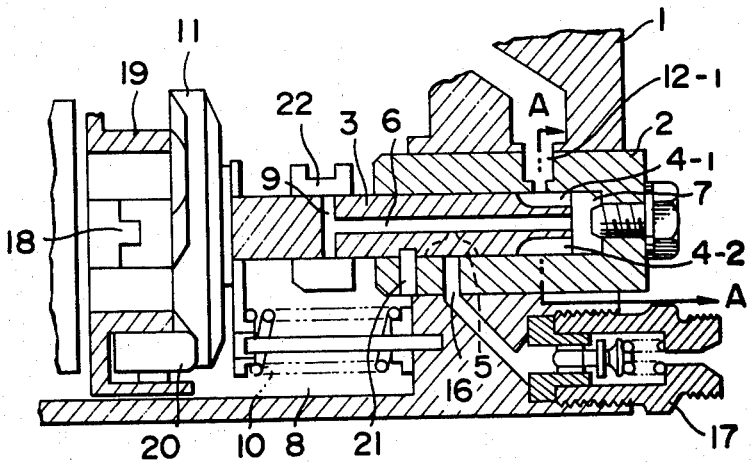
FIG. 1(*a*) is a longitudinal cross-sectional view of a fuel injection pump assembly according to an embodiment of the present invention.

FIGS. 1(*a*) and 1(*b*) illustrate a fuel injection pump assembly for distributing fuel under pressure to four cylinders of an internal combustion engine.

The fuel injection pump assembly comprises a pump head 1, a pump cylinder 2 affixed to the pump head 1, and a plunger 3 telescopically fitted in the pump cylinder 2, the plunger 3 being rotatable about its own axis. The plunger 3 has in an outer periphery thereof a pair of fuel supply slots 4-1, 4-2 which are angularly spaced 180 degrees. The fuel supply slots 4-1, 4-2 are half as many as the engine cylinders to which fuel is to be supplied from the fuel injection pump assembly. The plunger 3 has a fuel distribution hole 5 opening radially at a peripheral surface thereof, an axial elongate passage 6 having one end opening at an axial end of the plunger 3 within the pump cylinder 2 and held in fluid communication with the fuel distribution hole 5, and a cutoff hole 9 extending diametrically through the plunger 3 at a position outside of the pump cylinder 2 and communicating with the axial passage 6. The pump cylinder 2 has therein a pressurization chamber 7 partly defined by the plunger 3 and held in fluid communication with the fuel supply slots 4-1, 4-2 and the axial passage 6. The pump head 1 has a pump chamber 8 with which the cutoff hole 9 can communicate when the plunger 3 is axially displaced toward the pressurization chamber 7 to cause the cutoff hole 9 to be moved out of a control sleeve 22 disposed around the plunger 3 and controlled by a governor (not shown). The control sleeve 22 is positionally adjustable in an axial direction of the plunger 3. The plunger 3 supports a cam disc 11 on its end remote from the pressurization chamber 7, the cam disc 11 having raised cam surfaces spaced at angular intervals. The plunger 3 is normally urged by a compression coil spring 10 to move in a direction out of the pump cylinder 2.

Figure 1B:
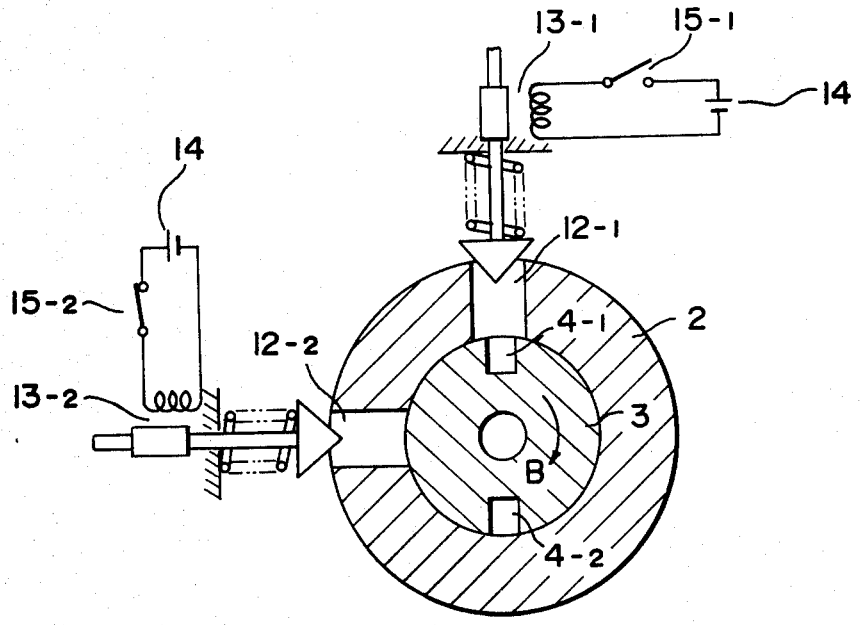

As best shown in FIG. 1*b*, the pump cylinder 2 has two fuel inlet ports 12-1, 12-2 which are angularly spaced from each other at an angle that is half the angle formed between the fuel supply slots 4-1, 4-2. Therefore, the fuel inlet ports 12-1, 12-2 are angularly spaced at 180 degrees $\times \frac{1}{2} = 90$ degrees. The fuel inlet ports 12-1, 12-2 are supplied with fuel from fuel supply passageways (not shown) connected therewith, respectively. The fuel inlet ports 12-1, 12-2 can be selectively opened or closed by solenoid-operated valves 13-1, 13-2, respectively, to control fuel supply or cutoff. The solenoid-operated valves 13-1, 13-2 are connected to power supplies 14, 14 through switches 15-1, 15-2, respectively.

The pump cylinder 2 has a plurality of fuel distribution ports 16 (only one shown in FIG. 1) which are spaced at angular intervals and are as many as the engine cylinders. The fuel distribution ports 16 are connected through passages in the pump head 1 and delivery valves 17 to the engine cylinders, respectively.

The cam disc 11 is axially coupled to a drive shaft 18 operatively connected to a crank shaft of the engine such that the cam disc 11 will rotate in synchronization with the rotation of the crank shaft. A roller holder 19 is fixed with respect to the drive shaft 18. A roller 20 is rotatably supported on the roller holder 19 and held in abutting engagement with the cam surfaces of the cam disc 11. When the drive shaft 18 rotates, the cam disc 11 and the plunger 3 rotate together at the same RPM as that of the drive shaft 18, and at the same time the plunger 3 is axially moved back and forth in strokes or cycles which are as many as the engine cylinders while the plunger 3 makes one revolution. Such reciprocable movement of the plunger 3 is caused by the cam surfaces on the cam disc 11 which are successively engaged by the roller 20 as the cam disc 11 rotates.

When both the switches 15-1, 15-2 are closed at the same time, the solenoid-operated valves 13-1, 13-2 are energized and opened simultaneously, allowing fuel supplied from a feed pump (not shown) to enter the fuel inlet ports 12-1, 12-2.

Assuming that the plunger 3 rotates clockwise in the direction of the arrow B (FIG. 1(*b*)) when the drive shaft 18 (FIG. 1(*a*)) rotates, fluid communication is provided successively between the fuel inlet port 12-1 and the fuel supply slot 4-1, between the fuel inlet port 12-2 and the fuel supply slot 4-2, between the fuel inlet port 12-1 and the fuel supply slot 4-2, and between the fuel inlet port 12-2 and the fuel supply slot 4-1, in the order named, while the plunger 3 makes one revolution about its own axis. Thus, any one of the fuel inlet ports 12-1 or 12-2 and any one of the fuel supply slots 4-1 or 4-2 are brought into alignment with each other for fluid communication each time the plunger 3 makes about a quarter of one complete revolution. Fuel is therefore supplied into the pressurization chamber 7 four times while the plunger 3 makes one revolution.

The fuel introduced into the pressurization chamber 7 is forced into the passage 6 when the plunger 3 is axially displaced into the pressurization chamber 7 after the fuel supply slot 4-1 or 4-2 has been brought out of the fuel inlet port 12-1 or 12-2. The fuel under pressure is fed through the fuel distribution hole 5 into one of the fuel distribution ports 16 which is held in communication with the fuel distribution hole 5 at the time. The fuel is then delivered via the delivery valve 17 connected to one of the fuel distribution ports 16 and injected into the corresponding engine cylinder through a fuel injection nozzle. When the plunger 3 is moved fully into the pump cylinder 2, the cutoff hole 9 is positioned out of the control sleeve 22 and the fuel under pressure is discharged from the passage 6 into the pump chamber 8 through the cutoff hole 9, whereupon fuel injection into the engine cylinder is completed. On returning movement of the plunger 3, the fuel distribution hole 5 allows the fuel distribution port 16 to communicate with the pump chamber 8 through a pressure uniformization port 21 in the pump cylinder 2. The fuel pressure in the passage in the pump head 1, which acts upstream of the delivery valve 17, is equalized with the pressure in the pump chamber 8. One cycle of fuel introduction, injection, and pressure uniformization is thus completed. Such a cycle is repeated to successively inject fuel into all of the engine cylinders, putting the latter into operation.

When the switch 15-1 is open and the switch 15-2 is closed, the solenoid-operated valve 13-1 is closed and the solenoid-operated valve 13-2 is open, as shown in FIG. 1(*b*), blocking off fuel supply into the fuel inlet port 12-1 and allowing fuel supply into the fuel inlet port 12-2.

No fuel is thus supplied from the fuel inlet port 12-1 when the fuel supply slot 4-1 or 4-2 is brought into alignment with the fuel inlet port 12-1. During one revolution of the plunger 3, fuel is fed into the pressurization chamber 7 only when the fuel supply slot 4-1 or 4-2 is aligned with the fuel inlet port 12-2. Accordingly, fuel is supplied only twice while the plunger 3 makes one revolution, and is injected into alternating engine cylinders with the remaining engine cylinders disabled or rendered inoperative. Only two out of the four engine cylinders work when the switch 15-1 is open and the switch 15-2 is closed. Conversely, when the switch 15-1 is closed and the switch 15-2 is open, the other two engine cylinders work with the remainder disabled.

When both of the switches 15-1, 15-2 are open, the solenoid-operated valves 13-1, 13-2 are both closed to prevent fuel from flowing into the fuel inlet ports 12-1, 12-2. No fuel is thus supplied into the pump cylinder 2 and hence into the engine cylinders, with the result that the engine stops operating.

FIG. 1(*b*) shows the fuel inlet port 12-1 at a reference position and the fuel inlet port 12-2 angularly spaced 90° from the fuel inlet port 12-1. However, instead of the fuel inlet port 12-2, a fuel inlet port may be defined in the pump cylinder 2 in diametrically symmetric relation to the fuel inlet port 12-2 with respect to a straight line extending through the fuel supply slots 4-1, 4-2 in the plunger 3. This alternative fuel inlet port is angularly spaced 270° from the fuel inlet port 12-1 at a reference position. The fuel inlet ports 12-1 and 12-2, angularly spaced 90° from each other as shown, correspond to two fuel inlet ports angularly spaced by the angle equal to the product of the angle (180°) formed between the fuel supply slots 4-1, 4-2 and $[(\frac{1}{2})+n$ (n=0 or a positive even number)[. The fuel inlet port 12-1 and the alternative inlet port angularly spaced 270° from the fuel inlet port 12-1 correspond to two fuel inlet ports angularly spaced by the angle equal to the product of the angle (180°) formed between the fuel supply slots 4-1, 4-2 and [(½)+n (n=a positive odd number)].

With the fuel injection pump assembly according to the embodiment as shown in FIGS. 1(*a*) and 1(*b*), only alternating two out of the four engine cylinders can be put into operation by opening either one of the switches 15-1, 15-2.

Figure 2:
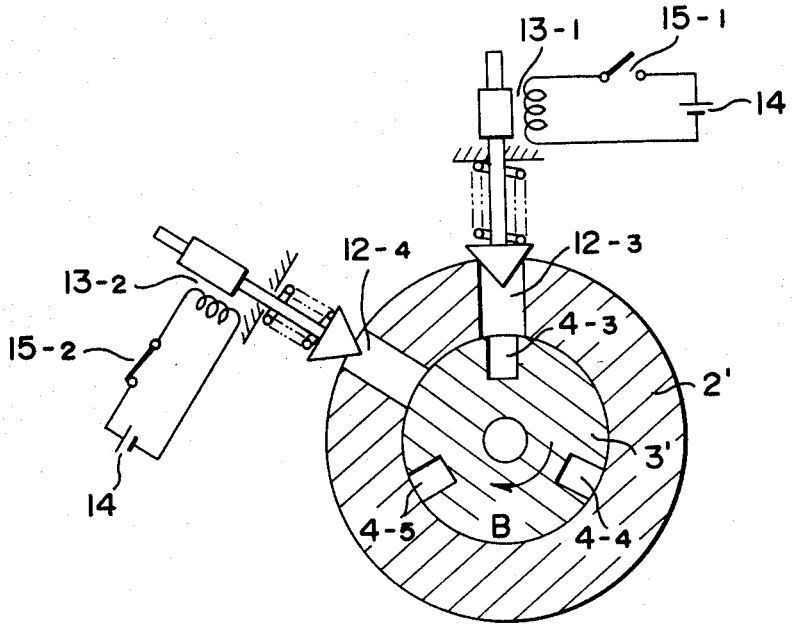
FIG. 2 is a transverse cross-sectional view of a fuel injection pump assembly according to another embodiment of the present invention.
Figure 3:
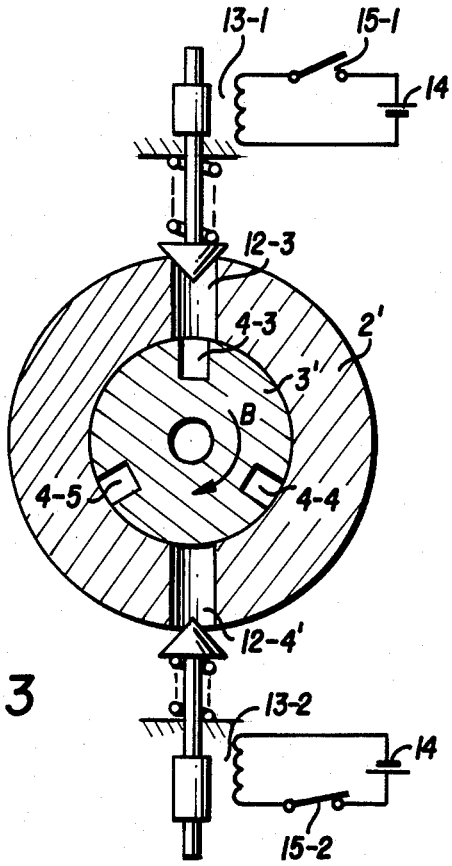
FIG. 3 is a transverse cross-sectional view of a fuel injection pump assembly according to a further embodiment of the present invention in which one fuel inlet port is angularly spaced 180° from another fuel inlet port.

A fuel injection pump assembly according to another embodiment as shown in FIG. 2 finds use with an engine having six cylinders. The fuel injection pump assembly includes a plunger 3' having in its outer periphery three fuel supply slots 4-3, 4-4, 4-5 which are angularly spaced 120 degrees, and a pump cylinder 2' having a pair of fuel inlet ports 12-3, 12-4 which are angularly spaced at an angle that is half the angle between adjacent fuel supply slots, that is, the angle of 120 degrees × ½ = 60 degrees. The fuel inlet ports 12-3, 12-4 are supplied with fuel from a feed pump (not illustrated) through solenoid-operated valves 13-1, 13-2, respectively. The other construction of the fuel injection pump assembly is the same as that of the fuel injection pump assembly illustrated in FIGS. 1(*a*) and 1(*b*).

When the switches 15-1, 15-2 are closed, the solenoid-operated valves 13-1, 13-2 are open to supply fuel into the fuel inlet ports 12-3, 12-4. Upon rotation of the plunger 3' in the clockwise direction B, the plunger 3' draws fuel six times while it makes one revolution. Fuel is thus injected into all of the six engine cylinders, which are put into operation.

When the switch 15-1 is open with the switch 15-2 closed, the solenoid-operated valve 13-1 is de-energized to close the fuel inlet port 12-3. Thus, no fuel is fed from the fuel inlet port 12-3 into the fuel supply slots 4-3, 4-4, 4-5 when the plunger 3' rotates. Fuel is supplied by the fuel injection pump assembly only three times while the plunger 3' makes one revolution. Fuel is thus injected into alternating engine cylinders. Stated otherwise, only three engine cylinders operate. Likewise, three out of the six engine cylinders work when the switch 15-1 is closed and the switch 15-2 is open.

With both of the switches 15-1, 15-2 open, the solenoid-operated valves 13-1, 13-2 are de-energized to stop fuel supply into the fuel inlet ports 12-3, 12-4, and no fuel at all is delivered into the pump cylinder 2'. Therefore, the engine is rendered inoperative.

The fuel injection pump assembly shown in FIG. 2 allows only alternating three out of the six engine cylinders to operate by opening either one of the switches 15-1, 15-2.

FIG. 2 illustrates the fuel inlet port 12-3 at a reference position and the fuel inlet port 12-4 angularly spaced 60° from the fuel inlet port 12-3. Instead of the fuel inlet port 12-4, however, a fuel inlet port may be defined in the pump cylinder 2' in angularly spaced relation to the fuel inlet port 12-3 by 180° or 300°. The fuel inlet ports 12-3 and 12-4, angularly spaced 60° as shown, correspond to two inlet ports angularly spaced by the angle equal to the product of the angle (120°) formed between adjacent fuel supply slots and {(½)+(n=0, 3, 6, 9, . . . )}. The fuel inlet port 12-3 and the alternative fuel inlet port angularly spaced 180° from the fuel inlet port 12-3 are equivalent to two inlet ports angularly spaced by the angle equal to the product of the angle (120°) formed between adjacent fuel supply slots and {(½)+(n=1, 4, 7, 10, . . . )}. The fuel inlet port 12-3 and the alternative fuel inlet port angularly spaced 300° from the fuel inlet port 12-3 are equivalent to two inlet ports angularly spaced by the angle equal to the product of the angle (120°) formed between adjacent fuel supply slots and {(½)+(n=2, 5, 8, 11, . . . )}.

FIG. 1(*b*) shows two fuel inlet ports 12-1, 12-2 (employed for four-cylinder engines), the fuel inlet port 12-1 at a reference position and the fuel inlet port 12-2 being angularly spaced 90° from the fuel inlet port 12-1. However, instead of the fuel inlet port 12-2, a fuel inlet port may be defined in the pump cylinder 2 in angularly spaced relation to the fuel inlet port 12-2 by 270°. Such an alternative performs the same operation as that of the illustrated fuel inlet ports 12-1, 12-2. Using "n", the fuel inlet ports 12-1 and 12-2, angularly spaced 90° from each other as shown, correspond to two fuel inlet ports angularly spaced by the angle equal to the product of the angle (180°) formed between the fuel supply ports 4-1, 4-2 and {(½)+(n=0 or a positive even number)}. The fuel inlet port 12-1 and the alternative inlet port angularly spaced 270° from the fuel inlet port 12-1 correspond to two fuel inlet ports angularly spaced by the angle equal to the product of the angle (180°) formed between the fuel supply ports 4-1, 4-2 and {(½)+n (n=a positive odd number)}.

FIG. 2 illustrates three fuel inlet ports (used for six-cylinder engines), the fuel inlet port 12-3 at a reference position, and the fuel inlet port 12-4 angularly spaced 60° from the fuel inlet port 12-3. Instead of the fuel inlet port 12-4, however, a fuel inlet port may be defined in the pump cylinder 2' in angularly spaced relation to the fuel inlet port 12-3 by 180° or 300°. Such alternatives perform the same operation as that of the illustrated fuel inlet ports 12-3, 12-4. Using "n" as above, the fuel inlet ports 12-3, 12-4 angularly spaced 60° as shown to correspond to two inlet ports angularly spaced by the angle equal to the product of the angle (120°) formed between adjacent fuel supply ports and {(½)+(n=0, 3, 6, 9 . . . )}. The fuel inlet port 12-3 and the alternative fuel inlet port angularly spaced 180° from the fuel inlet port 12-3 are equivalent to two inlet ports angularly spaced by the angle equal to the product of the angle (120°) formed between adjacent fuel supply ports and {(½)+(n=1, 4, 7, 10, . . . )}. The fuel inlet port 12-3 and the alternative fuel inlet port angularly spaced 300° from the fuel inlet port 12-3 are equivalent to two inlet ports angularly spaced by the angle equal to the product of the angle (120°) formed between adjacent fuel supply ports and {(½)+(n=2, 5, 8, 11, . . . )}. Accordingly, if "n" is a positive integer greater than zero in the 120 degree case, the angle obtained is indicated by the formula given above.

With the arrangement of the present invention, the number of operating engine cylinders can be reduced by blocking the fuel supply into one of the fuel inlet ports in the pump cylinder while the engine is operating at an idle speed or under a low load, thus preventing incomplete fuel combustion and reducing smelly exhaust gas.

Although certain preferred embodiments have been shown and described in detail, it should be understood that many changes and modifications may be made therein without departing from the scope of the appended claims.

What is claimed is:

1. A fuel injection pump assembly for an engine having a plurality of cylinders, comprising:

a pump cylinder having a pair of fuel inlet ports, a plurality of fuel distribution ports which are equal in number to the cylinders of the engine and which lead to the cylinders, a pressurization chamber;

a plunger rotatably and telescopically mounted in said pump cylinder and having fuel supply slots for selective communication between said fuel inlet ports and said pressurization chamber, and a passageway held in selective communication between said pressurization chamber and said fuel distribution ports, said fuel supply slots being half the number of the cylinders of the engine and angularly equally spaced at a first angle, said fuel inlet ports being angularly spaced from each other at a second angle which is equal to the product of said first angle and $(\frac{1}{2})+n$ where $n=0$ or a positive integer, said plunger being rotatable about its own axis in response to rotation of the engine and reciprocable in strokes which are equal in number to the cylinders of the engine per rotation of the engine for selectively supplying fuel from said fuel inlet ports through said fuel supply slots, through said pressurization chamber, and through said passageway to said fuel distribution ports; and means for selectively opening and closing said fuel inlet ports, whereby selected ones of the cylinders of the engine can be disabled when said fuel inlet ports are selectively closed by said means so that incomplete fuel combustion in prevented and smelly exhaust gas is reduced.

2. A fuel injection pump assembly according to claim 1, wherein said means comprises a pair of solenoid-operated valves which are energizable and de-energizable to open and close said fuel inlet ports, respectively.

3. A fuel injection pump assembly according to claim 1, wherein said first angle is 180 degrees, and said integer n is 0.

4. A fuel injection pump assembly according to claim 1, wherein said first angle is 120 degrees, and said integer n is 0.

* * * * *